United States Patent [19]

Rohner et al.

[11] 4,424,663

[45] Jan. 10, 1984

[54] THREAD SPLICING DEVICE

[75] Inventors: Joachim Rohner; Heinz Zumfeld; Reinhard Mauries, all of Monchen-Gladbach; Hans-Jürgen Preuhs, Willich, all of Fed. Rep. of Germany

[73] Assignee: W. Schlafhorst & Co., Mönchengladbach, Fed. Rep. of Germany

[21] Appl. No.: 315,402

[22] Filed: Oct. 27, 1981

[30] Foreign Application Priority Data

Oct. 29, 1980 [DE] Fed. Rep. of Germany ..... 3040588

[51] Int. Cl.[3] ..... B65H 69/06; D01H 15/00; D02J 1/08

[52] U.S. Cl. ..... 57/22; 57/333

[58] Field of Search ..... 57/22, 23, 333, 350; 28/271–276

[56] References Cited

U.S. PATENT DOCUMENTS

| | | | |
|---|---|---|---|
| 3,306,020 | 2/1967 | Rosenstein | 57/22 |
| 3,345,809 | 10/1967 | Gemeinhardt et al. | 57/22 |
| 3,407,583 | 10/1968 | Irwin et al. | 57/22 |
| 3,477,217 | 11/1969 | Bell et al. | 57/22 |
| 3,648,336 | 3/1972 | Bevington, Jr. | 57/22 X |
| 4,002,012 | 1/1977 | Norris et al. | 57/22 |

*Primary Examiner*—John Petrakes

*Attorney, Agent, or Firm*—Herbert L. Lerner; Laurence A. Greenberg

[57] ABSTRACT

Thread splicing device, including a stationary base body having a first compressed-air canal formed therein, a splicing head being interchangeably connected to the base body, the splicing head having a second compressed-air canal formed therein being in communication with the first compressed-air canal formed in the base body and the splicing head having a splicing chamber formed therein being in communication with the second compressed-air canal formed in the splicing head, the splicing chamber including a selectively coverable longitudinal slot having a slot bottom and being operable for inserting and joining threads, the slot having a substantially circular cross section, at least in the vicinity of the bottom thereof, forming a partly full circle leaving an open aperture for inserting and removing the threads.

36 Claims, 39 Drawing Figures

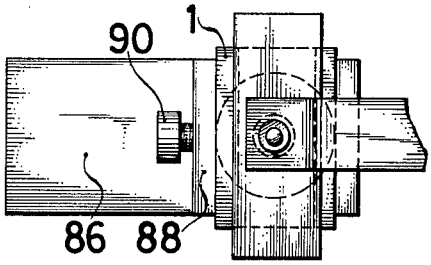
FIG. 2
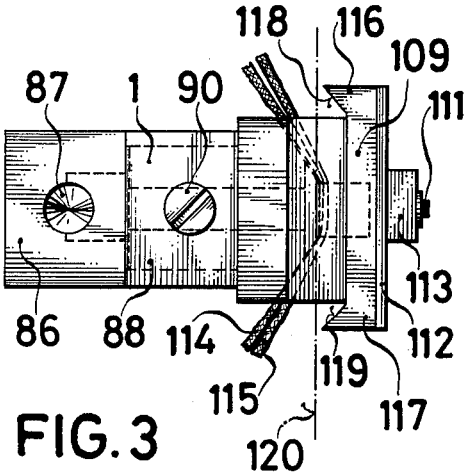
FIG. 3
FIG. 1
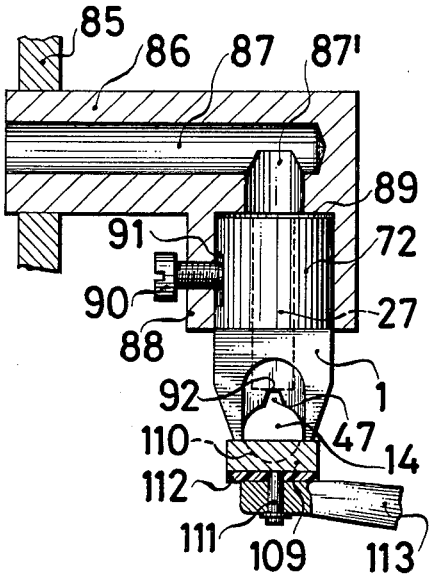

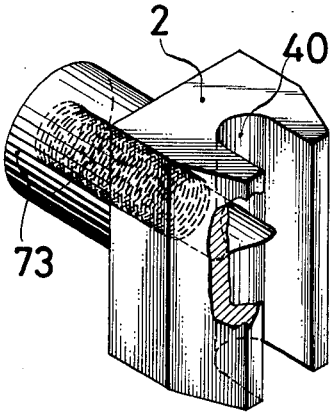
FIG. 4
FIG. 6
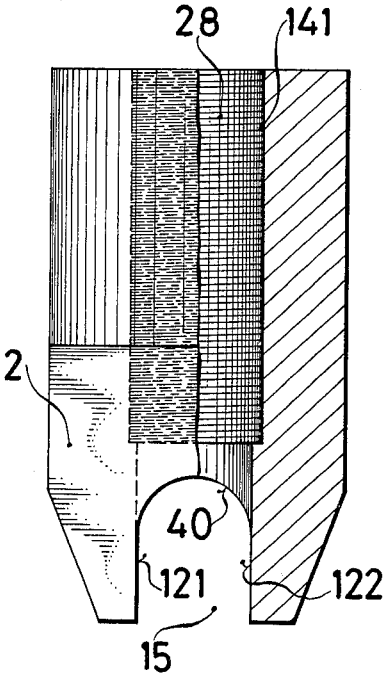
FIG. 5
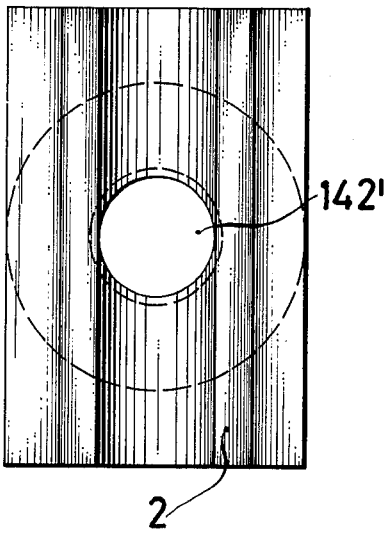

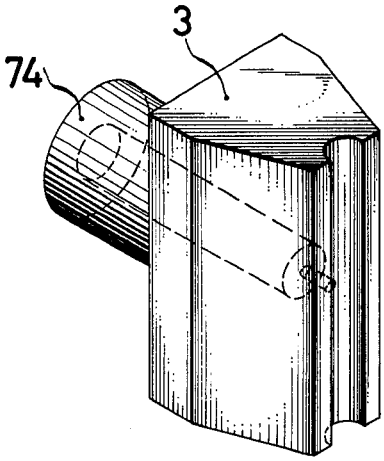
FIG. 7
FIG. 9
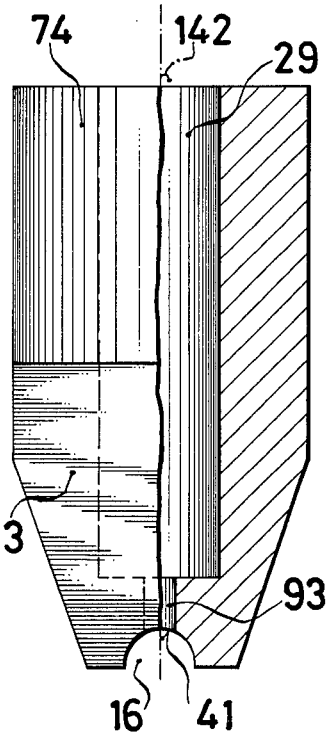
FIG. 8
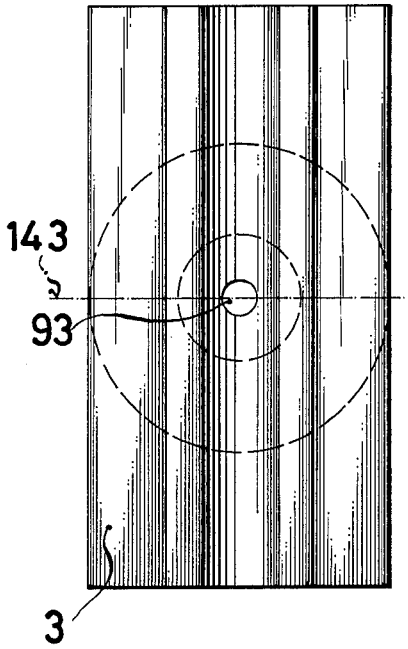

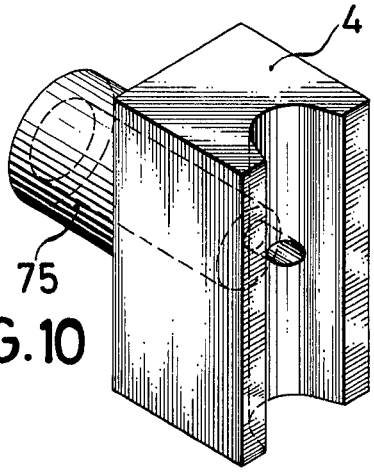
FIG. 10
FIG. 12
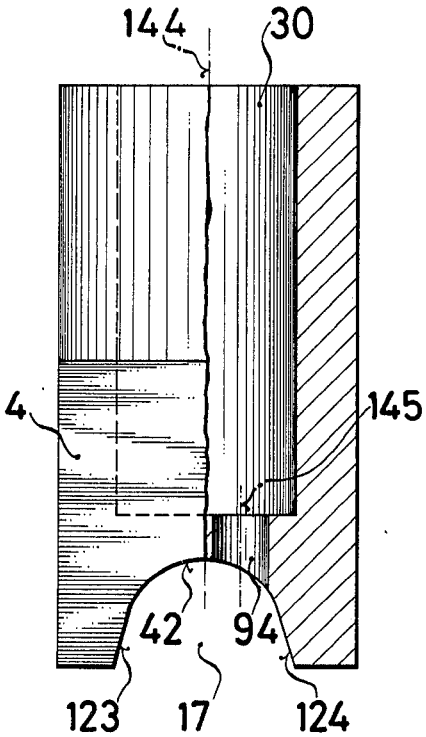
FIG. 11
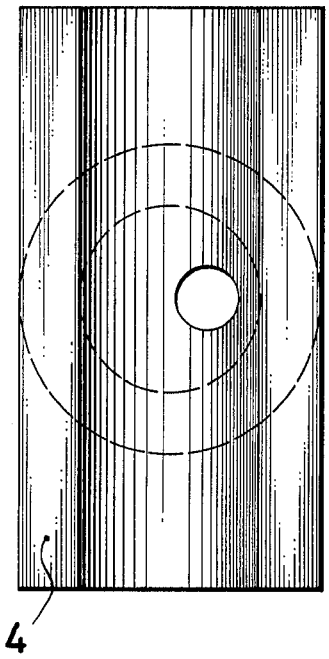

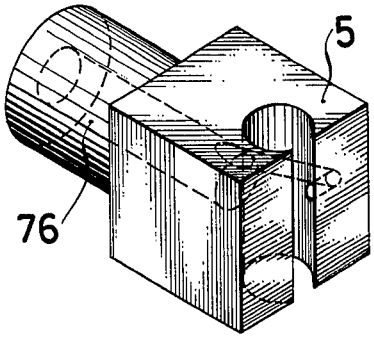
FIG. 13
FIG. 15
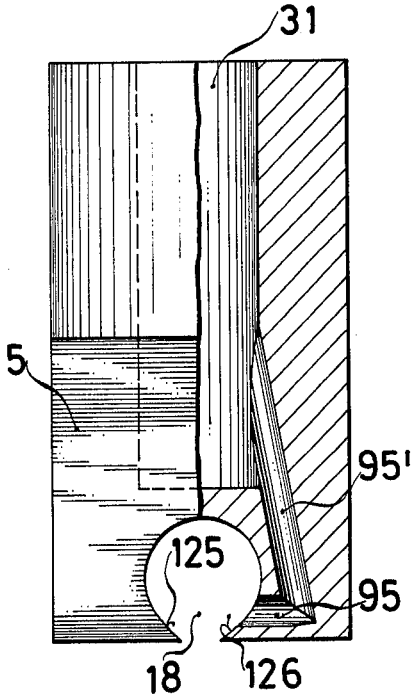
FIG. 14
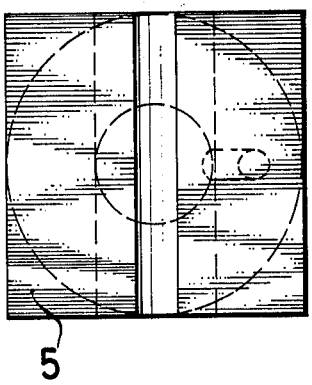

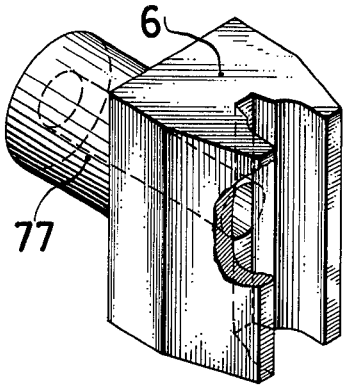
FIG.16
FIG.18
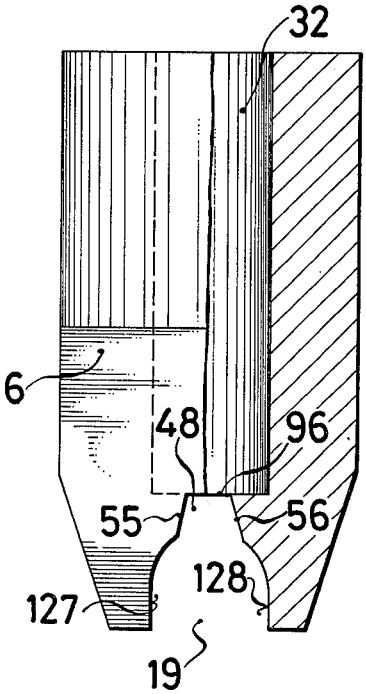
FIG.17
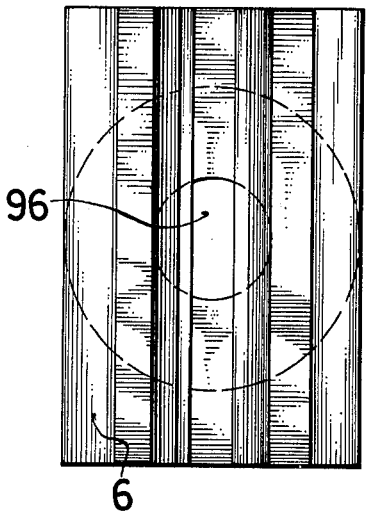

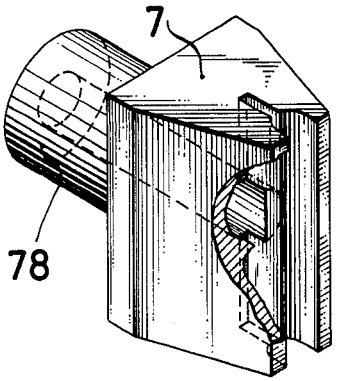
FIG.19
FIG.21
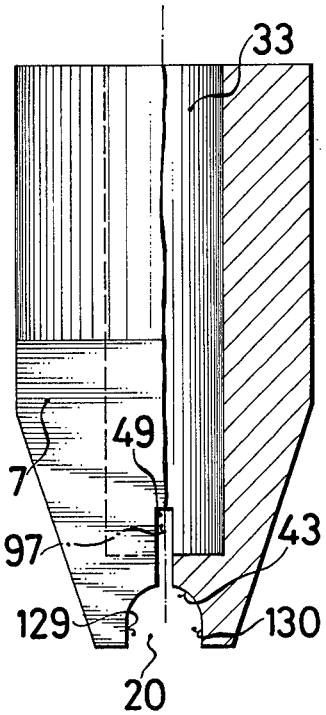
FIG.20
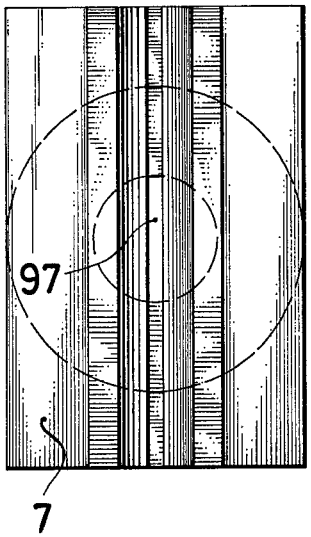

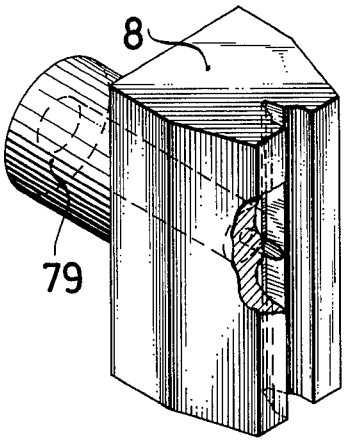
FIG. 22
FIG. 24
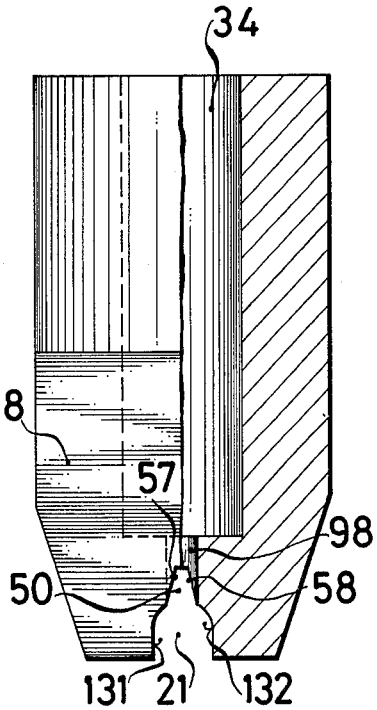
FIG. 23
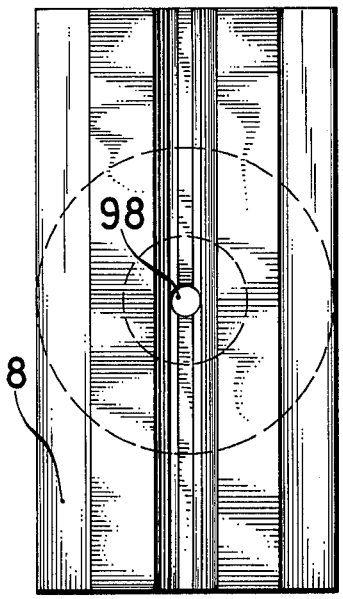

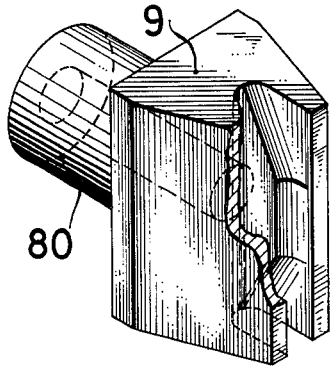
FIG. 25
FIG. 27
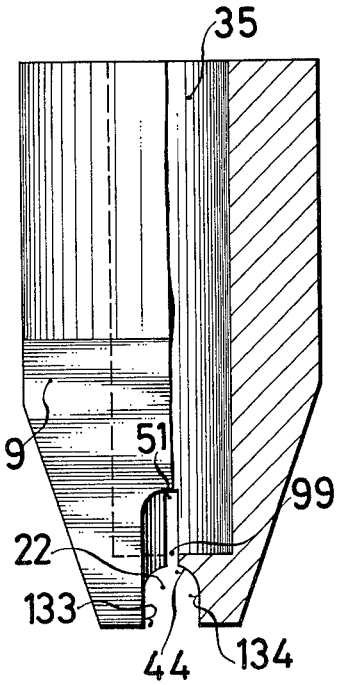
FIG. 26
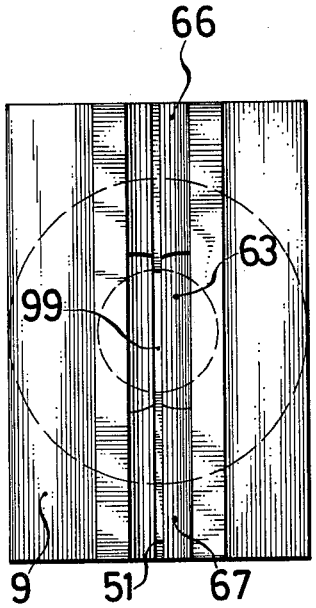

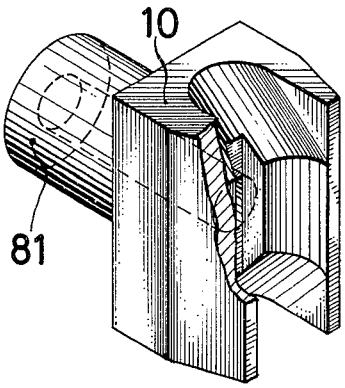
FIG. 28
FIG. 30
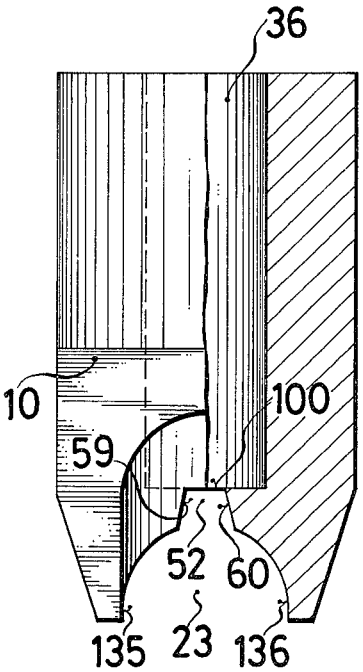
FIG. 29
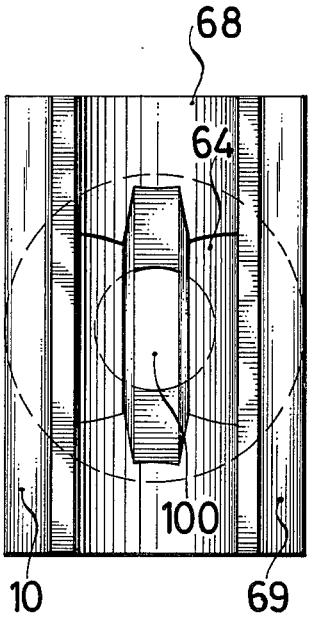

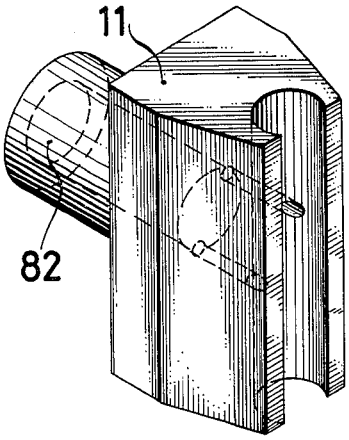
FIG. 31
FIG. 33
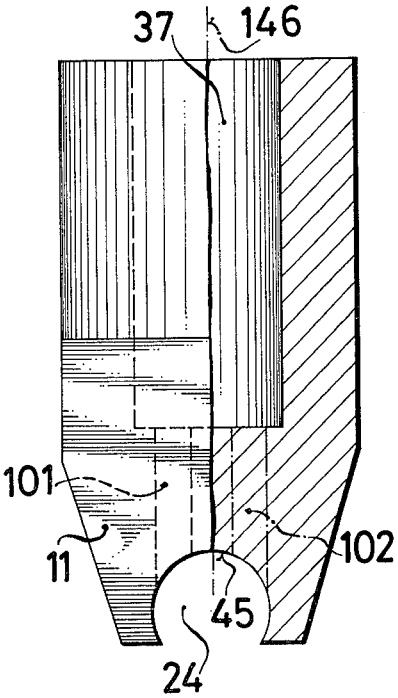
FIG. 32
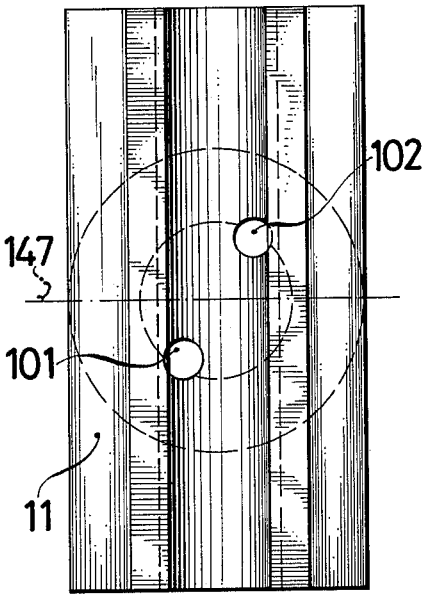

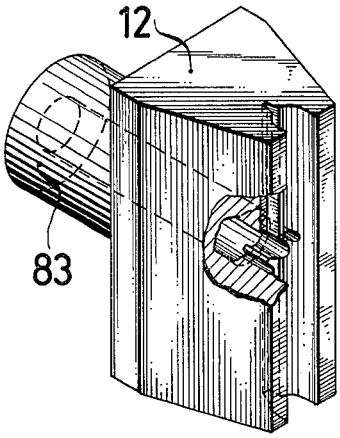
FIG. 34
FIG. 36
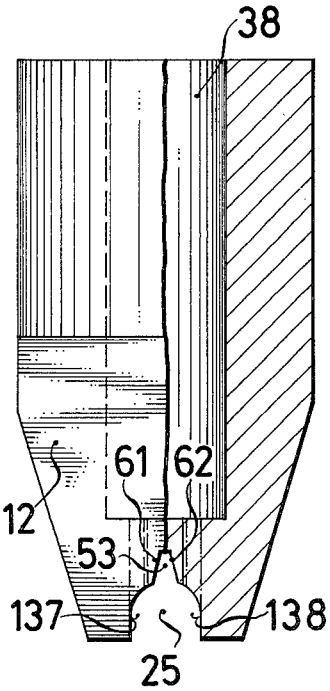
FIG. 35
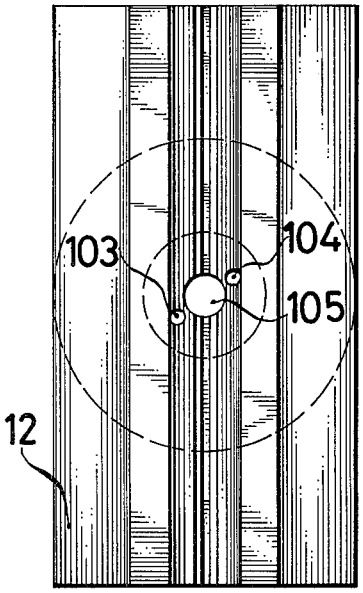

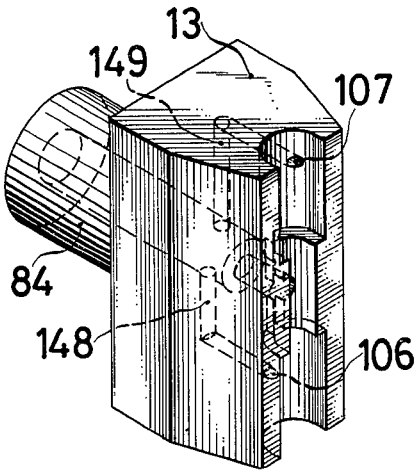
FIG. 37
FIG. 39
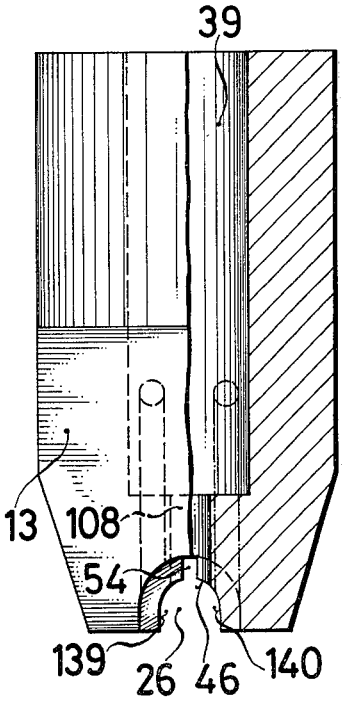
FIG. 38
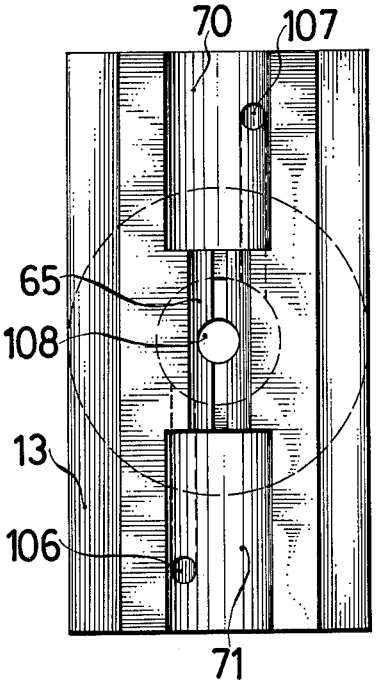

THREAD SPLICING DEVICE

The invention relates to a thread splicing device with a splicing head which includes a splicing chamber with an optionally coverable longitudinal slot for inserting and joining the threads, a compressed-air canal opening into the splicing chamber and an optional cover for temporarily covering the longitudinal slot.

Since the possibilities for using the known thread splicing devices are limited and one and the same splicing head cannot be used very well for different threads and yarns, such as long-staple yarns, short-staple yarns, or for different yarn thicknesses and different yarn twists, it has already been proposed in co-pending U.S. application Ser. No. 225,636, filed Jan. 16, 1981, now abandoned, to provide a stationary base body with a canal carrying compressed air and to connect the splicing head to the base body so that it is easy to interchange heads. It was left open in this publication as to what the details of the nature and the construction of the splicing head must be to accomplish effective splicing of given yarns, twines and threads.

It is accordingly an object of the invention to provide a thread splicing device which overcomes the hereinafore-mentioned disadvantages of the heretofore-known devices of this general type, and in which the splicing heads thereof are not only easy to interchange but in which each individual splicing head is already adjusted for effective splicing of given yarns, twines and threads.

The basic idea of the invention is to see to it that the shape, cross section, arrangement, covering and ratio of the cross section of the longitudinal slot to the length of the longitudinal slot, as well as shape, cross section, arrangement, orientation and entrance of the compressed air canal and the ratio of the cross section of the longitudinal slot to the cross section of the mouth of the compressed air canal leading into the longitudinal slot are adapted to the diameter, cross section, volume, number, twist, type of fiber, length of fiber, structure of the fibers, surface structure of the fibers, surface roughness of the fibers, staple length, surface structure of the thread, thread roughness and/or moisture content, degree of electrostatic charge, content of sizing, and content of foreign bodies of the threads to be joined together, in an optimal manner.

With the foregoing and other objects in view there is provided, in accordance with the invention, a thread splicing device, comprising a stationary base body having a first compressed-air-carrying canal formed therein, a splicing head being interchangeably connected to the base body, the splicing head having a second compressed air canal formed therein being in communication with the first compressed air canal formed in the base body and a splicing head having a splicing chamber formed therein being in communication with the second compressed-air canal formed in the splicing head, the splicing chamber including a selectively coverable longitudinal slot having a slot bottom and being operable for inserting and joining threads, the slot having a substantially circular cross section, at least in the vicinity of the bottom thereof, forming a partly full circle leaving a more or less large open aperture remaining for inserting and removing the threads. The diameter of the circle is larger for thicker yarns, for higher air pressure and heavy yarn twist or twine twist, respectively, and for lower moisture content and higher electrostatic charge of the thread.

In accordance with another feature of the invention, there is provided a cover for temporarily covering the longitudinal slot during splicing.

In accordance with a further feature of the invention, the splicing head has substantially straight lateral boundaries formed at the cross section of the longitudinal slot above the circular slot bottom. These lateral boundaries can be disposed parallel to each other. However, they can also converge or diverge upward. Parallel or diverging lateral boundaries are particularly suitable for splicing very coarse yarns, such as for splicing rug yarns or wool yarns, or for splicing yarns with a large content of foreign bodies. Converging lateral boundaries are particularly well suited for splicing cotton threads and heavily sized threads.

In accordance with an added feature of the invention, the splicing head has a substantially V or U-shaped groove being formed therein at the slot bottom and extended along the longitudinal slot. This groove has two purposes. First, it can be made so wide that it initially accepts the threads to be spliced. It is then ensured that the threads will lie close to each other prior to the splicing process proper. The groove, however, can also serve the purpose of better distributing the splicing air and of accelerating the threads to be spliced toward the cover. To meet this requirement, in accordance with an additional requirement of the invention, the splicing head has a compressed-air exit or discharge nozzle being formed therein in the groove communicating with the second compressed-air canal.

Effective splicing, i.e. good mixing of the fibers, is achieved if, in accordance with again another feature of the invention, the groove has lateral boundaries being disposed at an angle of substantially 30° to each other. With this construction of the lateral boundaries, the compressed air emerging at the bottom of the groove has an optimum fan effect and due to the inclined position of the lateral boundaries, the threads to be inserted are brought into good contact with each other.

In accordance with again a further feature of the invention, the longitudinal slot has two end sections of relatively larger cross section and a middle section of relatively smaller cross section. A splicing head constructed in this manner is suitable for splicing thin as well as thick threads. When inserted, the threads lie close together in the middle section. Generally, the air supply also takes place there. The length of the middle section again depends on the specifications of the threads.

In accordance with again an added feature of the invention, the size of the cross sections changes relatively abruptly between the middle and end sections. In accordance with again an additional feature of the invention, the size of the cross sections changes relatively gradually between said middle and end sections. Both constructions have advantages for certain threads. For coarse threads, a gradual change of cross section is preferred. For finer yarns, a sudden cross section change may be advantageous, especially if, in accordance with a further embodiment of the invention, the relatively larger cross sections of the end sections are extended toward sides of the longitudinal slot. In this case, the narrowly bounded part of the bottom of the slot in which the threads lie is not included in the enlargement of the cross section. If, on the other hand, coarser yarns are spliced, it is of advantage if in accordance with yet another feature of the invention, the relatively larger cross sections of the end sections are extended toward or from the bottom of the longitudinal slot.

An enlarged cross section of the end sections can also be achieved by rounding the edges of the longitudinal slot. Since rounding the edges also facilitates the insertion of the threads and avoids damage, in accordance with yet a further feature of the invention, the longitudinal slot has rounded and smoothed edges. It is understood that all edges of the longitudinal slots are included.

Effective, optimally spliced joints are obtained if, in accordance with yet an added feature of the invention, the ratio of the length of the longitudinal slot to the cross section thereof is between 0.5 and 1.0. This applies, for instance, for splicing coarse yarns. For splicing medium-fine yarns it is advantageous if in accordance with yet an additional feature of the invention, the ratio of the length of the longitudinal slot to the cross section thereof is between 1.0 and 1.5. For very fine or coarsely twisted yarns it is advantageous if in accordance with still a further feature of the invention, the ratio of the length of the longitudinal slot to the cross section thereof is between 2.5 and 4.0, i.e. a cross section of the slot of 1 $mm^2$ is available for each 2.5 to 4.0 mm slot length. The difference in these ranges, however, does not preclude that under special conditions dimensional ratios outside or between these ranges can also be advantageous.

In accordance with another feature of the invention, the splicing head has at least one air exit nozzle formed therein at an end of the second compressed-air canal formed in the splicing head toward the splicing chamber, the air exit nozzle having at least one of a smaller open cross section and/or a different cross-sectional shape than the second compressed-air canal. At the transition into the air exit nozzle, a discontinuity thus exists in every case, which advantageously triggers air turbulance. If the free cross section of the air exit nozzle is smaller than the free cross section of the compressed-air canal, the pressure drop of the compressed-air canal is not as noticeable during the splicing.

Normally, the longitudinal slot of the splicing head is symmetrically formed. Under this condition, in accordance with a further feature of the invention, at least one of the second compressed-air canal and/or exit nozzle is disposed at the intersection of two planes of symmetry of the longitudinal slot. Both cases have advantages. A compressed-air canal located at the intersection of the symmetry planes has advantages for the external construction and with regard to interchangeability of the splicing head itself. An air exit nozzle located at the crossing of the symmetry planes distributes the air uniformly and allows air to emerge in a uniformly distributed manner towards both ends of the longitudinal slot.

In accordance with an added feature of the invention, the longitudinal slot has a side wall, and the longitudinal axis of the air exit nozzle is directed substantially tangentially toward the side wall. With such an orientation of the air exit nozzle, air turbulence is formed in the longitudinal slot which facilitates splicing high-twist yarns or short-staple yarns such as cotton yarns.

In accordance with an additional feature of the invention, the air exit nozzle is in the form of a plurality of air exit nozzles connected to the second compressed-air canal. This proposal opens up many possibilities for optimum splicing. For one thing, it is possible to bring about individual spliced joints at larger or smaller distances from each other by providing air exit nozzles distributed along the longitudinal slot. On the other hand, in the case of heavily twisted yarns, the yarn twist can be undone more advantageously by appropriate air turbulence if, in accordance with again another feature of the invention, the air exit nozzles are disposed on two sides, i.e. to the left and right, of a symmetry plane passing legthwise through the longitudinal slot. The compressed-air canal cam be connected, for instance, to two air exit nozzles, one of which is formed to the left and the other to the right of the symmetry plane going through the length of the slot.

The air exit nozzles can be directly opposite each other, for instance. For splicing heavily twisted yarns, however, it is better if in accordance with again a further feature of the invention, the air exit nozzles are disposed on two sides, i.e. to the left and right of a symmetry plane passing transversely through said longitudinal slot. If, for instance, two air exit nozzles are provided, then one air exit nozzle can be formed to the left and the other air exit nozzle to the right of the symmetry plane going transversely through the longitudinal slot.

In accordance with again an added feature of the invention, if several air exit nozzles are provided one of the air exit nozzles is disposed at the intersection of symmetry planes passing lengthwise and transversely through the longitudinal slot, respectively. Such an arrangement has the particular advantage of ensuring that an air jet flows into the splicing chamber or into the longitudinal slot which does not generate a rotating air swirl but enters centrally to the threads to be spliced. The other air exit nozzles may be disposed in such a way that air swirls are formed. For instance, three air exit nozzles are then provided according to the last-mentioned feature, one air exit nozzle being disposed at the crossing of the symmetry planes, while the location of the other two air exit nozzles is optional. The nozzles are then accomodated either in the middle section also, or advantageously in the end sections of the longitudinal slot.

The ratio of the cross section of the longitudinal slot to the total cross section of the air exit nozzles has an influence on the effectiveness and the optimum success of the splicing, and on the quality of the spliced joint. In accordance with again an additional feature of the invention, the ratio of the cross section of the longitudinal slot to the combined cross section of the air exit nozzles is between 1.4 and 3.0 or 3.7 and 4.0 or 7.0 and 9.0. The first mentioned range is advantageous for threads of large bulk, such as wool threads, rug yarns and the like. The medium range from 3.7 to 4.0 is particularly well suited for simple yarns and mixed-wool yarns; and the range from 7.0 to 9.0 is particularly well suited for splicing cotton yarns and high-twist yarns, especially in connection with an arrangement of the air exit nozzles such that a rotary flow is generated. Preference for these three ranges, however, does not preclude that under special conditions cross section ratios which are outside or between these ranges can also be advantageous.

In order to ensure that the air jets emerging from the air exit nozzles do not have an adverse mutual affect, in accordance with yet another feature of the invention, the central axes of the air exit nozzles are disposed parallel to a line formed by the intersection of the symmetry planes of the longitudinal slot.

It has already been mentioned above that a turbulent flow has advantages for splicing. Therefore, in accordance with yet a further feature of the invention, there is provided a turbulence generator at least partly disposed in the second compressed-air canal. In accordance with yet an added feature of the invention, the turbulence generator is in the form of an obstacle extended transversely through the second compressed-air canal. Such an obstacle is easy to make and to install. It may be an inserted pin or a canal insert. In accordance with yet an additional feature of the invention, the second compressed-air canal has a wall, and the turbulence generator is in the form of macroscopic irregularities formed in the wall. Wall irregularities smaller than macroscopic ones do not lead to sufficient turbulence, according to experience. In accordance with still a further feature of the invention, the wall irregularities are in the form of a screw thread formed in the wall of the second compressed-air canal. Since the compressed-air canal usually has a circular cross section, such a screw thread is easy to make. By choosing the pitch and the depth of the thread, the effectiveness of the wall irregularities can easily be varied.

In accordance with another feature of the invention, the splicing head includes a plug-in base projecting into the base body, the second compressed-air channel being at least partly formed in the plug-in base. This has various advantages. Firstly, a seal between the base body and the splicing head can be accomplished sufficiently by the labyrinth effect without particular sealing means, and secondly the splicing head is firmly mounted in the base body. Thirdly, the plug-in base simultaneously serves as a wall of the compressed-air canal.

To prevent the splicing head from turning, and in order to connect the splicing head to the base body quickly and securely, while retaining the easy replaceability, in accordance with a further feature of the invention, the plug-in base has a cylindrical outer surface having a flat area formed thereon, and the base body includes a holding element directed toward the flat area. Such a holding element can be fastening screw, for instance, the end of which is aimed at the flat of the plug-in base. Other holding elements can also be used, such as switching pins with spring loading, pawls operable by hand with spring loading, or the like.

In the interest of effective splicing the interaction between the cover and the splicing head must also be considered.

In order to prevent a poorly constructed cover from canceling the good air guidance and the optimum splicing effect obtained through the use of the invention, in accordance with an added feature of the invention, the cover has ends extended beyond the splicing head in the axial direction of the longitudinal slot, and includes thread hold-down devices disposed at the ends. The emerging air flows at the same time against these thread hold-down devices, which thus influence the splicing process directly. In addition, they serve for holding the threads or for limiting the thread motion during the splicing process.

In accordance with a concomitant feature of the invention, in order for the air flow to be able to flow out of the splicing head readily and at the same time to damp the thread movement, the thread hold-down devices have air-guiding surfaces disposed thereon being obliquely directed against the travel direction of the threads to be spliced.

All in all the invention provides an expert with knowledge necessary for constructing the splicing head in such a way that it is adapted overall to the diameter, cross section, volume, number, twist, type of fiber, fiber length, fiber structure, surface structure of the fibers, surface roughness of the fibers, staple length, surface structure of the thread, thread roughness and/or moisture content, degree of electrostatic charge, sizing content, and content of foreign bodies of the threads to be joined together, in an optimum manner.

Other features which are considered as characteristic for the invention are set forth in the appended claims.

Although the invention is illustrated and described herein as embodied in a thread splicing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, cross-sectional view of a first embodiment of the thread splicing device according to the invention;

FIGS. 2 and 3 are bottom plan and side elevational views, respectively, of FIG. 1;

FIG. 4 is a perspective view, partly broken away, of a splicing head according to a second embodiment of the invention;

FIG. 5 is a front elevational view of FIG. 4;

FIG. 6 is a top plan view of FIG. 4, the part thereof to the right of the center line being cut open; and FIGS. 7–39 are views of the third through thirteenth embodiments of the invention, each embodiment being illustrated in a respective perspective, front elevational, and top plan view, similar to FIGS. 4–6.

Referring now to the figures of the drawing and first particularly to FIGS. 1–3 thereof, there is seen a thread splicing device showing only essential details, including a frame 85, which supports a base body 86. The base body 86 has an angled-off, compressed-air-carrying canal 87, 87'. The base body 86 further has a holding device for a splicing head 1, including an eye 88 having a receiving hole 89 formed therein, and a holding element in the form of a fastening screw 90. A counterpart of this holding device is provided at the splicing head 1 in the form of a cylindrical plug-in base 72, which has a flat 91 formed thereon against which the holding element 90 is directed.

The splicing head 1 has a splicing chamber in the form of a longitudinal slot 14 formed therein. A compressed-air canal 27 leads through the plug-in base 72 up to the vicinity of the longitudinal slot 14, where it ends at an air exit nozzle 92. The air exit nozzle 92 has a smaller free cross sectional area than the cylindrical compressed-air canal 27. The air exit nozzle 92 also has a different cross section; it is slit-shaped.

The splicing head 1 can be covered up by a pivotable cover 109. The cover 109 has a smooth surface facing the longitudinal slot 14. However, the cover 109 is optionally provided with a longitudinal slot 110 which is better fitted to the cross-sectional shape of the longitudinal slot 14 of the splicing head 1. The cover 109 is fastened to a cover holder 113 by means of a holding device 111, with the interposition of a resilient plastic plate 112.

It is seen particularly from FIG. 3 that the cover 109 which temporarily covers the longitudinal slot 14 during the splicing of threads 114, 115, extends beyond the splicing head 1 in the direction of the longitudinal slot 14 and has thread hold-down devices 116, 117 at the ends thereof. The thread hold-down device 116 has an air-guiding surface 118 formed thereon, and the thread hold-down device 117 has an air-guiding surface 119. The air-guiding surfaces are directed at an angle against the travel direction 120 of the threads 114, 115 to be spliced together, as indicated by a dot-dash line.

In the second embodiment example of the invention seen in FIGS. 4, 5 and 6, a splicing head 2 is shown with a plug-in base 73, the dimensions of which agree with the plug-in base of the previous embodiment example. A longitudinal slot 15 shown in the figures has a substantially circular cross section at the bottom 40 thereof, and approximately straight lateral boundaries 121, 122 above the circular slot bottom 40. The lateral boundaries 121, 122 are opposite and parallel to each other.

It is seen in FIG. 6 that a compressed-air canal 28 is provided with a turbulence generator in the form of a screw head 141. At its end, the compressed-air canal 28 becomes an air exit nozzle 142', which has a free or open cross section that is not quite as large as the compressed-air canal, and which also has no wall irregularities.

In the third embodiment example according to FIGS. 7, 8 and 9, a splicing head 3 is shown, which has a plug-in base 74 similar to the second embodiment example. A compressed-air canal 29 in this embodiment becomes an air exit nozzle 93 which has a smaller free or available cross section than the compressed-air canal 29. The air exit nozzle 93 opens into a slot bottom 41 of a longitudinal slot 16 which has a semi-circular cross section. It is seen from FIGS. 8 and 9 that the compressed-air canal 29 as well as the air exit nozzle 93 are disposed at the intersection of a symmetry plane 142 which passes through the longitudinal slot 16, and a symmetry plane 143 which passes transversely through the longitudinal slot. The two symmetry planes are perpendicular to each other.

In the fourth embodiment according to FIGS. 10, 11 and 12, which is also particularly well suited for especially dry and electrostatically charged threads, a splicing head 4 with a plug-in base 75 is seen. A longitudinal slot 17 has a circular cross section only at the bottom 42 of the slot, which becomes approximately straight divergent lateral boundaries 123, 124 above the slot bottom. The free or available cross section of the compressed-air canal 30 is substantially larger than the cross section of the air exit nozzle 94 which leads into the longitudinal slot 17 with a central axis 145 that is parallel to the central axis 144 of the compressed-air canal 30.

In the fifth embodiment example of the invention shown in FIGS. 13, 14 and 15, a splicing head 5 with a plug-in base 76 can be seen. In this embodiment, the cross section of the longitudinal slot 18 forms a circle which is not completely closed and which merges into straight lateral boundaries 125, 126 which in this case do not diverge but converge.

In this embodiment example, the guidance of the air has a peculiarity in that the compressed-air canal 31 leads through a canal section 95' having a reduced cross section, into an air exit nozzle 95, the central axis of which is directed approximately tangentially against the opposite side wall of the longitudinal slot 18.

In this embodiment example of the invention, the ratio of the length of the longitudinal slot 18 to the cross section of the longitudinal slot 18, i.e. to the cross-sectional area, is 0.6 and the ratio of the slot cross section to the air exit nozzle cross section is 8.9.

In the sixth embodiment example of the invention according to FIGS. 16, 17 and 18, the splicing head 6 has a plug-in base 77. The longitudinal slot 19 is of circular cross section at the bottom of the slot and then changes into straight lateral boundaries 127, 128, which are parallel and opposite to each other. The bottom of the slot in this embodiment has a substantially V-shaped groove 48 which extends along the longitudinal slot 19. The air exit nozzle 96 is located directly at the flat slot bottom of the groove 48 and accordingly, as can be clearly seen from FIG. 17, is slit-shaped. Thus, the cross section of the air exit mozzle 96 deviates from the circular cross section of the compressed-air canal 32.

In this embodiment example, the ratio of the length of the longitudinal slot to the cross section of the longitudinal slot is 0.9 and the ratio of the slot cross section to the air exit nozzle cross section is 1.4.

In the seventh embodiment example, a splicing head 7 with a plug-in base 79 is seen in FIGS. 19, 20 and 21. In this embodiment too, the longitudinal slot 20 has a substantially circular cross section at its slot bottom 43 which then becomes straight and parallel opposite lateral boundaries 129, 130.

A substantially partly rectangular or U-shaped groove 49 extends from the bottom of the slot. In a part of the regoin covered by the groove, the groove 49 simultaneously forms a slit-shaped air exit nozzle 97 as can be seen particularly clearly in FIG. 20. Furthermore, the air exit nozzle in this embodiment has a substantially smaller free or available cross section and in addition, an entirely different cross-sectional shape than the compressed-air canal 33.

In the eight embodiment example of the invention, a splicing head 8 with a plug-in base 79 is seen in FIGS. 22, 23 and 24. The cross section of the longitudinal slot 21 is circular at the bottom of the slot and then merges into straight and parallel lateral boundaries 131, 132. A substantially V-shaped groove 50 extends from the bottom of the slot and has a flat bottom and lateral boundaries which are disposed at an angle of about 30° relative to each other, similar to the lateral boundaries 55, 56 of the groove 48 of the sixth embodiment example.

In this embodiment the compressed air also emerges into the groove 50, and specifically through an air exit nozzle 98 which has a substantially smaller cross section than the compressed-air canal 34 which feeds the compressed air.

The ratio of the length of the longitudinal slot to the cross section of the longitudinal slot is 2.7 in this embodiment example and the ratio of the slot cross section to the air exit nozzle cross section is 2.3.

In the ninth embodiment example of the invention a splicing head 9 with a plug-in base 80 is seen in FIGS. 25, 26 and 27. In this embodiment the cross section of the longitudinal slot 22 is approximately semi-circular at the bottom 44 of the slot and then merges into straight parallel boundaries 133, 134. The bottom of the slot 44 has a substantially U-shaped groove 51 formed therein which extends along the longitudinal slot 22.

The longitudinal slot 22 is divided, according to FIG. 26, into three sections, namely a middle section 63 and two end sections 66, 67. The two end sections have a larger cross section than the middle section; the enlarged cross section of the end sections 66, 67 extends with gradual cross-sectional enlargement from the bottom 44 of the slot to the bottom of the groove 51, which the two end sections then also reach at the very end.

The air exit nozzle 99 is formed by a construction in which the groove 51 extends into the compressed-air canal 35. A slit-like cross section of the air exit nozzle 99 in angled-off form is then obtained.

In this embodiment example, the ratio of the length of the longitudinal slot to the cross section of the longitudinal slot is 1.2, with respect to the middle section 62, and the ratio of the slot cross section to the air exit nozzle cross section is 3.0.

In the tenth embodiment of the invention according to FIGS. 28, 29 and 30, the splicing head 10 has a plug-in base 81. Here, the longitudinal slot 23 has an approximately semi-circular cross section at the bottom thereof which becomes short end sections 135, 136 which are disposed opposite each other. In this embodiment the bottom of the slot has a rather large substantially V-shaped groove 52, the lateral boundaries 59, 60 of which form an angle of about 30° with each other.

The air exit nozzle 100 in FIGS. 28–30 is disposed directly at the bottom of the V-shaped groove 52. It is seen, particularly in FIG. 29, that the free or available cross section of the air exit nozzle 100 is only about half as large as the free cross section of the compressed-air canal 36.

In this case as well, the longitudinal slot 23 is divided into a middle section 64 and two end sections 68, 69. Toward the ends thereof, the end sections 68, 69 are gradually enlarged but the transition between the middle section and the end sections is erratic, yet not grossly erratic.

It is seen particularly from FIG. 30 that the enlarged cross section of the end sections 68, 69 extends from the bottom of the slot.

With respect to the middle section 64, the ratio of the length of the longitudinal slot to the cross section of the longitudinal slot is 0.9 in this embodiment example, and the ratio of the slot cross section to the air exit nozzle cross section is 1.4.

An eleventh embodiment example of the invention is shown in FIGS. 31, 32 and 33. The splicing head 11 in this case has a plug-in base 82. The cross section of the longitudinal slot 24 is circular but the circle is not closed. The symmetrical longitudinal slot 24 has two preferred symmetry planes 146, 147 which are perpendicular to each other.

In this embodiment example, two air exit nozzles 101, 102 are provided. Both nozzles open into the bottom of the slot 45. FIG. 33 shows that the air exit nozzle 101 is disposed to the left, and the air exit nozzle 102 to the right, of the symmetry plane 146 which goes through the length of the slot 24. FIG. 32 shows that the air exit nozzle 101 is disposed below, and the air exit nozzle 102 is above, the symmetry plane 147 which extends transversely to the longitudinal slot 24.

This special arrangement of the air exit nozzles is particularly suitable for threads which have a Z-twist. If, on the other hand, referring to the view of FIG. 32, the air exit nozzle 102 is disposed at the top left and the air exit nozzle 101 at the bottom right, this construction is better suited for threads with an S-twist.

The drawings show that the total cross section of the air exit nozzles is substantially smaller than the free or available cross section of the compressed-air canal 37.

A twelfth embodiment example of the invention is shown in FIGS. 34, 35 and 36. The splicing head 12 in this embodiment has a plug-in base 83. The longitudinal slog 25 has an approximately semi-circular cross section at the bottom of the slot, which merges into parallel lateral sections 137, 138. A groove 53 which extends from the bottom of the slot has lateral boundaries 61, 62 that form an angle of about 30° with each other. The groove 53 does not extend in this case into the compressed-air canal 38.

Three air exit nozzles 103, 104 and 105 are provided. The air exit nozzle 105 is centrally disposed and ends centrally in the groove 53. The nozzle 105 has a larger free or available cross section than the other air exit nozzles 103 and 104 which are disposed in a manner similar to the preceding embodiment example.

The nozzle construction chosen has the advantage that primarily, a centrally directed flow is brought onto the threads to be spliced, but that in addition limited rotary flows are also brought to the threads and into the splicing chamber for aiding the central flow.

A thirteenth embodiment example of the invention is shown in FIGS. 37, 38 and 39. The splicing head 13 in this case has a plug-in base 84 through which a compressed-air canal is formed as in the other embodiment examples.

The splicing head 13 in this embodiment has several peculiarities which together have the effect of allowing this splicing head to be used somewhat more universally. The longitudinal slot 26 is approximately semi-circular at the bottom 46 of the slot, but then merges outwardly into short, straight, parallel lateral boundaries 139, 140.

In this embodiment example, the longitudinal slot 26 is divided into three sections which are of approximately equal length, namely a middle section 65 and two end sections 70, 71. In the middle section 65 there is seen a groove 54 which starts out from the slot bottom 46 and has a substantially U-shaped cross section. The cross-sectional shape of the end sections 70 and 71 otherwise resembles the cross-sectional shape of the middle section with the exception that the end sections have no groove.

The cross section of the two end sections is larger than the cross section of the middle section. The change in the cross section is abrupt. The enlarged cross section of the end sections extends in this case to the sides of the longitudinal slot as well as from the slot bottom of the longitudinal slot.

Three exit nozzles 106, 107, 108 are provided. The air exit nozzle 108 is located, as is readily seen, in the intersection of the symmetry plane which passes lengthwise through the longitudinal slot, with the symmetry plane perpendicular thereto. The air exit nozzle 106 is located in the end section 71 and the air exit nozzle 107 in the end section 70 and more specifically, to the left and to the right, respectively, of the symmetry plane passing lengthwise through the longitudinal slot.

The air exit nozzle 108 opens centrally into the compressed-air canal 39. The air exit nozzle 106 is connected by a small transverse canal 148, and the air exit nozzle 107 by a small transverse canal 149, to the compressed-air canal 39 as shown in particular in FIG. 37.

The air exit nozzle 108 is located in the longitudinal axis of the commpressed-air canal 39. The central axis of the air exit nozzles 106 and 107 are parallel to the central axis of the compressed-air canal 39.

In this embodiment example, the air exit nozzles are considerably farther apart from each other than in the previous embodiment example.

The splicing head 13 is particularly well suited for splicing thin, heavily twisted threads and for splicing threads of special sensitivity. Its field of application, however, also extends to coarser threads.

This embodiment example of the invention is again particularly well suited for Z-twisted threads. For S-twisted threads, the air exit nozzle 106, referring to the view of FIG. 39, can be displaced to the right and the air exit nozzle 107 to the left.

In all embodiment examples of the invention, the edges of the longitudinal slot should be rounded and smooth. This is particularly pointed out because it cannot be seen directly from the views of the drawings.

The invention is not limited to the embodiment examples shown and described. All features of the embodiment examples described and shown can be interchanged with each other as desired and can be combined with each other.

There are claimed:

1. Thread splicing device, comprising a stationary base body having a first compressed-air canal formed therein, a splicing head being interchangeably connected to said base body, said splicing head having a second compressed-air canal formed therein being in communication with said first compressed-air canal formed in said base body and said splicing head having a splicing chamber formed therein being in communication with said second compressed-air canal formed in said splicing head, said splicing chamber including a selectively coverable longitudinal slot having a slot bottom and being operable for inserting and joining threads, said slot having a substantially circular cross section, at least in the vicinity of said bottom thereof, forming a partly full circle leaving an open aperture for inserting and removing the threads, and said longitudinal slot having two end sections of relatively larger cross section and a middle section of relatively smaller cross section.

2. Thread splicing device according to claim 1, including a cover for temporarily covering said longitudinal slot.

3. Thread splicing device according to claim 2, wherein said cover has ends extended beyond said splicing head in the axial direction of said longitudinal slot, and includes thread hold-down devices disposed at said ends.

4. Thread splicing device according to claim 3, wherein said thread hold-down devices have air-guiding surfaces disposed thereon being obliquely directed against the travel direction of the threads to be spliced.

5. Thread splicing device according to claim 1, wherein said splicing head has substantially straight lateral boundaries formed at the cross section of said longitudinal slot above said circular slot bottom.

6. Thread splicing device according to claim 1, wherein said splicing head has a substantially V-shaped groove being formed therein at said slot bottom and extended along said longitudinal slot.

7. Thread splicing device according to claim 1, wherein said splicing head has a substantially U-shaped groove being formed therein at said slot bottom and extended along said longitudinal slot.

8. Thread splicing device according to claim 6 or 7, wherein said splicing head has a compressed-air exit nozzle being formed therein in said groove communicating with said second compressed-air canal.

9. Thread splicing device according to claim 8, wherein said groove has lateral boundaries being disposed at an angle of substantially 30° to each other.

10. Thread splicing device according to claim 6 or 7, wherein said groove has lateral boundaries being disposed at an angle of substantially 30° to each other.

11. Thread splicing device according to claim 1, wherein the size of the cross sections changes relatively abruptly between said middle and end sections.

12. Thread splicing device according to claim 1, wherein the size of the cross sections changes relatively gradually between said middle and end sections.

13. Thread splicing device according to claim 1, wherein said relatively larger cross sections of said end sections are extended toward sides of said longitudinal slot.

14. Thread splicing device according to claim 1, wherein said relatively larger cross sections of said end sections are extended toward the bottom of said longitudinal slot.

15. Thread splicing device according to claim 1, wherein said relatively larger cross sections of said end sections are extended from the bottom of said longitudinal slot.

16. Thread splicing device according to claim 1, wherein said longitudinal slot has rounded and smoothed edges.

17. Thread splicing device according to claim 1, wherein the ratio of the length of said longitudinal slot to the cross section thereof is between 0.5 and 1.0.

18. Thread splicing device according to claim 1, wherein the ratio of the length of said longitudinal slot to the cross section thereof is between 1.0 and 1.5.

19. Thread splicing device according to claim 1, wherein the ratio of the length of said longitudinal slot to the cross section thereof is between 2.5 and 4.0.

20. Thread splicing device, comprising a stationary base body having a first compressed-air canal formed therein, a splicing head being interchangeably connected to said base body, said splicing head having a second compressed-air canal formed therein being in communication with said first compressed-air canal formed in said base body and said splicing head having a splicing chamber formed therein being in communication with said second compressed-air canal formed in said splicing head, said splicing chamber including a selectively coverable longitudinal slot having a slot bottom and being operable for inserting and joining threads, said slot having a substantially circular cross section, at least in the vicinity of said botto thereof, forming a partly full circle leaving an open aperture for inserting and removing the threads, and said splicing head having at least one air exit nozzle formed therein at an end of said second compressed-air canal formed in said splicing head toward said splicing chamber, said air exit nozzle having at least one of a smaller open cross section and a different cross-sectional shape than said second compressed-air canal.

21. Thread splicing device according to claim 20, wherein at least one of said second compressed-air canal and exit nozzle is disposed at the intersection of two planes of symmetry of said longitudinal slot.

22. Thread splicing device according to claim 20, wherein said longitudinal slot has a side wall, and the longitudinal axis of said air exit nozzle is directed toward said side wall.

23. Thread splicing device according to claim 20, wherein said air exit nozzle is in the form of a plurality of air exit nozzles connected to said second compressed-air canal.

24. Thread splicing device according to claim 23, wherein said air exit nozzles are disposed on two sides of a symmetry plane passing lengthwise through said longitudinal slot.

25. Thread splicing device according to claim 23, wherein said air exit nozzles are disposed on two sides of a symmetry plane passing transversely through said longitudinal slot.

26. Thread splicing device according to claim 23, wherein one of said air exit nozzles is disposed at the intersection of symmetry planes passing lengthwise and transversely through said longitudinal slot, respectively.

27. Thread splicing device according to claim 20, 21, 22, 23, 24, 25 or 26, wherein the ratio of the cross section of said longitudinal slot to the combined cross section of said air exit nozzles is between 1.4 and 3.0.

28. Thread splicing device according to claim 20, 21, 22, 23, 24, 25 or 26, wherein the ratio of the cross section of said longitudinal slot to the combined cross section of said air exit nozzles is between 3.7 and 4.0.

29. Thread splicing device according to claim 20, 21, 22, 23, 24, 25 or 26, wherein the ratio of the cross section of said longitudinal slot to the combined cross section of said air exit nozzles is between 7.0 and 9.0.

30. Thread splicing device according to claim 20, 21, 22 or 23, wherein the central axes of said air exit nozzles are disposed parallel to a line formed by the intersection of the symmetry planes of said longitudinal slot.

31. Thread splicing device, comprising a stationary base body having a first compressed-air canal formed therein, a splicing head being interchangeably connected to said base body, said splicing head having a second compressed-air canal formed therein being in communication with said first compressed-air canal formed in said base body and said splicing head having a splicing chamber formed therein being in communication with said second compressed-air canal formed in said splicing head, said splicing chamber including a selectively coverable longitudinal slot having a slot bottom and being operable for inserting and joining threads, said slot having a substantially circular cross section, at least in the vicinity of said bottom thereof, forming a partly full circle leaving an open aperture for inserting and removing the threads, and including a turbulence generator at least partly disposed in said second compressed-air canal.

32. Thread splicing device according to claim 31, wherein said turbulence generator is in the form of an obstacle extended transversely through said second compressed-air canal.

33. Thread splicing device according to claim 31, wherein said second compressed-air canal has a wall, and said turbulence generator is in the form of macroscopic irregularities formed in the wall.

34. Thread splicing device according to claim 33, wherein said wall irregularities are in the form of a screw thread formed in the wall of said second compressed-air canal.

35. Thread splicing device, comprising a stationary base body having a first compressed-air canal formed therein, a splicing head being interchangeably connected to said base body, said splicing head having a second compressed-air canal formed therein being in communication with said first compressed-air canal formed in said base body and said splicing head having a splicing chamber formed therein being in communication with said second compressed-air canal formed in said splicing head, said splicing chamber including a selectively coverable longitudinal slot having a slot bottom and being operable for inserting and joining threads, said slot having a substantially circular cross section, at least in the vicinity of said bottom thereof, forming a partly full circle leaving an open aperture for inserting and removing the threads, and said splicing head including a plug-in base projecting into said base body, said second compressed-air canal being at least partly formed in said plug-in base.

36. Thread splicing device according to claim 35, wherein said plug-in base has a cylindrical outer surface having a flat area formed thereon, and said base body includes a holding element directed toward said flat area.

* * * * *